United States Patent [19]

Raines

[11] Patent Number: 4,587,910

[45] Date of Patent: May 13, 1986

[54] WORKPIECE HOLDING DEVICE FOR AUTOMATIC SEWING

[75] Inventor: Max Raines, Salem, Mass.

[73] Assignee: USM Corporation, Farmington, Conn.

[21] Appl. No.: 646,810

[22] Filed: Sep. 4, 1984

[51] Int. Cl.[4] ..... D05B 21/00

[52] U.S. Cl. ..... 112/121.12; 112/121.15

[58] Field of Search ..... 112/121.12, 121.15, 112/121.11, 2, 102

[56] References Cited

U.S. PATENT DOCUMENTS

| | | | |
|---|---|---|---|
| 1,092,038 | 3/1914 | Gerber | 112/121.12 |
| 1,251,677 | 1/1918 | McDonald | 112/121.12 |
| 2,094,528 | 9/1937 | Daughters | 112/121.12 |
| 3,034,458 | 5/1962 | Bennison | 112/121.12 |
| 3,599,583 | 8/1971 | Berman et al. | 112/121.12 |

FOREIGN PATENT DOCUMENTS

| | | | |
|---|---|---|---|
| 1525794 | 4/1968 | France | 112/121.11 |

*Primary Examiner*—H. Hampton Hunter

*Attorney, Agent, or Firm*—William F. White

[57] ABSTRACT

A workpiece holder which is attachable to the positioning apparatus of an automatic sewing machine includes a plurality of sharp pointed pins extending upwardly from a base plate. The workpiece which may comprise one or more individual elastic pieces is mounted on the sharp pointed pins. A cover plate, pivotally attached to the base plate, covers the thus mounted workpiece in such a manner that the sharp pointed pins are shielded from contact with the operator of the sewing machine.

13 Claims, 4 Drawing Figures

WORKPIECE HOLDING DEVICE FOR AUTOMATIC SEWING

FIELD OF THE INVENTION

This invention relates to the holding of workpieces that are to be sewn by an automatic sewing machine. In particular, this invention relates to the registering of a workpiece within a workpiece holder so that it may be sewn by the automatic stitching machine.

BACKGROUND OF THE INVENTION

U.S. Pat. No. 3,988,993 to Robert V. Brophy discloses a workpiece holding arrangement for use with automatic sewing machines. The workpiece holding arrangement consists of a book pallet having hinged leaves that are used to orient and locate several pieces of work which are to be sewn together. In this regard, each leaf of the book pallet contains one or more cavities that orient and accurately register the pieces of work that are to be sewn with respect to each other. The book pallet is connected to a high resolution positioning system which accurately positions the pieces of work relative to a reciprocating sewing needle.

Various other approaches have been used in orienting pieces of work that are to be registered with respect to each other and thereafter sewn by an automatic sewing machine. These approaches have included using a few pins strategically located within the pallet. Workpieces having the same pattern of holes therein are positioned over the pins. Still another approach has been to clamp the workpiece parts relative to each other after having aligned an edge of at least one piece with respect to an edge guide. Examples of these workpiece registration clamps are illustrated in U.S. Pat. No. 4,171,672 and U.S. Pat. No. 4,455,952.

The above arrangements for workpiece registration work well with material such as leather that is stiff enough to be manipulated relative to an edge, or positioned over pins or located within a cavity. A workpiece of a less stiff nature often requires a different approach. One such approach is disclosed in U.S. Pat. No. 4,449,463. The workpiece in this patented arrangement is placed between clamps which subject the workpiece to tension. This is a rather sophisticated arrangement for stretching the workpiece while registering it for sewing.

OBJECTS OF THE INVENTION

It is an object of the present invention to provide a workpiece registration and clamping device that allows at least one piece of flexible fabric to be accurately registered and held for automatic sewing.

It is another object of the present invention to provide a workpiece registration and clamping device that does not require an elaborate mechanism to stretch and position the one or more pieces that are to be accurately registered and held for automatic sewing.

SUMMARY OF THE INVENTION

The above and other objects are achieved according to the present invention by a workpiece holding arrangement having a base plate with a plurality of sharp pins extending upwardly therefrom. A base piece of a workpiece, which may be elastic, is positioned over all of the sharp pins. The number and spacing of the pins is such as to maintain the base piece in a stretched and flat position. A subset of these pins is located around the periphery of at least one opening in the base plate which is covered when the base piece of the work has been positioned. A second piece of work, which may also be elastic, is now positioned over the subset of pins located around the periphery of the opening. A second plate, preferably hinged to the base plate, is now pivoted downwardly over the positioned pieces of work. The second plate has a plurality of holes therein which allow the sharp locating pins extending upwardly from the base plate to project therethrough. The second plate moreover has separate shields associated with each projecting pin so as to guard against any undesirable contact therewith during the subsequent handling of the workpiece holding arrangement. In this regard, the operator takes the workpiece holder and attaches it to a positioning apparatus of an automatic sewing machine. The accurately registered pieces of work within the workpiece holder are successively positioned under the reciprocating sewing needle which sews the pieces of work together. The shields mounted to the cover plate do not interfere with the needle as the workpiece holder is being moved by the positioning apparatus during automatic sewing. The workpiece holder may be subsequently removed from the sewing machine and opened so as to remove the joined pieces. It is to be appreciated that all such handling of the workpiece holder can be accomplished without concern for the sharp points of the locating pins which remain shielded.

DESCRIPTION OF THE PREFERRED EMBODIMENT

Figure 1:
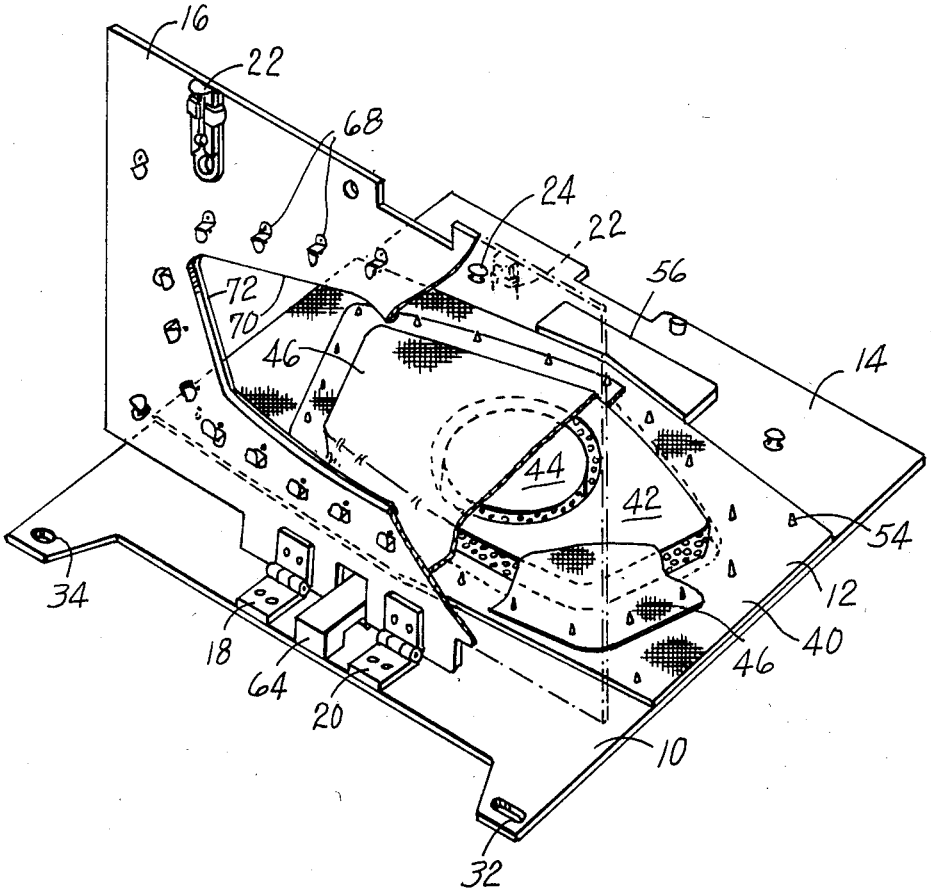
FIG. 1 is a perspective view of a workpiece holder in an open position with a workpiece located therein.

Referring to FIG. 1, a workpiece holder 10 is illustrated in an open position with a workpiece 12 located therein. The workpiece 12 is held in place by a number of sharp pointed pins which extend upwardly from a base plate 14. A cover plate 16 is pivotally attached via a set of hinges 18 and 20 to the base plate 14. The cover plate 16 pivots downwardly over the base plate and is latched thereto by a pair of slideable latches (such as latch 22) which engage posts (such as post 24). The series of sharp pointed pins extend upwardly through holes in the cover plate 16 at this time. These pins are shielded by individual shield devices mounted to the top of the cover plate. The workpiece 12, located within the closed workpiece holder 10, is now ready for further processing. In this regard, a person picks up the workpiece holder 10 and connects it to the positioning apparatus of an automatic sewing machine.

Figure 2:
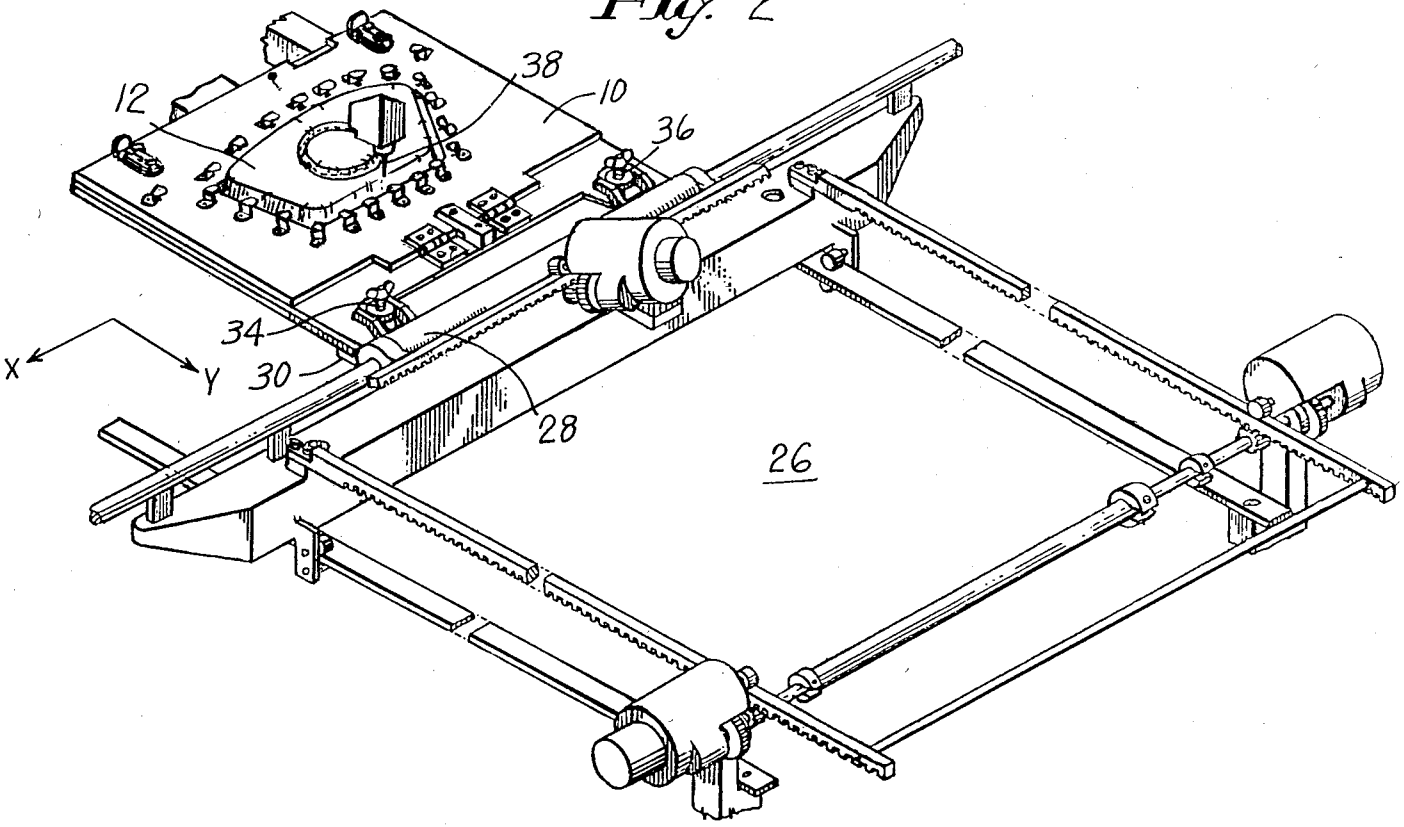
FIG. 2 is a view of the workpiece holder of FIG. 1 connected to positioning apparatus of an automatic sewing machine.

Referring to FIG. 2, the workpiece holder 10 is generally illustrated relative to a positioning apparatus 26 of an automatic sewing machine. The positioning apparatus includes a moveable carriage 28 having a shelf 30 which receives the workpiece holder 10. Referring to FIG. 1, the workpiece holder 10 has a registration slot 32 and a registration hole 34. These are located over registration posts 36 and 38 extending upwardly from the shelf 30 of the movable carriage 28. The thus registered workpiece holder may be secured by any convenient means such as clamps or threadable devices. The workpiece holder 10 is now in a plane defined by the shelf 30 and the bed (not shown) of a stationary automatic sewing machine. The workpiece holder 10 is movable in the indicated X and Y directions of movement by the positioning apparatus so as to present the workpiece 12 under a reciprocating sewing needle 38 associated with the stationary head of the automatic sewing machine. It is to be appreciated that the degree of accuracy in presenting the workpiece for sewing is premised in part upon the accurate registration of the workpiece within the workpiece holder 10.

Figure 3:
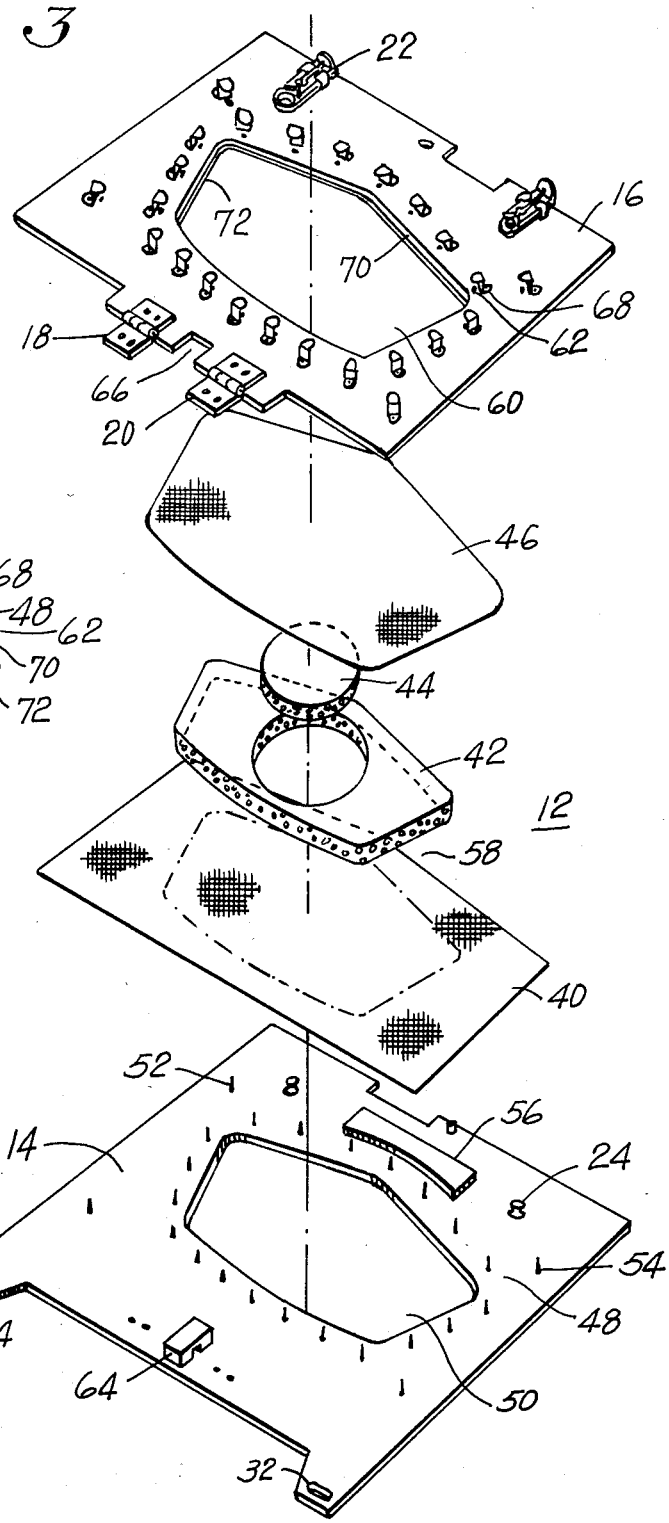
FIG. 3 is an exploded view of the workpiece holder and workpiece.

The accurate registration and holding of the workpiece 12 within the workpiece holder 10 will now be explained relative to FIG. 3. FIG. 3 is an exploded view of both the workpiece holder 10 and the workpiece 12. The various portions of the workpiece 12 are situated between the base plate 14 and the cover plate 16. The workpiece 12 is seen to comprise: a bottom piece 40, an intermediate set of pieces 42 and 44 plus a top piece 46. It is to be understood that the workpiece 12 will eventually become an elastic support for a human knee. In this regard, the bottom piece 40 and the top piece 46 are made from conventional elastic materials normally found in elastic knee supports. The intermediate pieces 42 and 44 are foam rubber parts having a thickness of approximately four tenths (0.4) of an inch . The piece 44 approximates the size of a knee cap and fits within the hole in the piece 42. The pieces 40, 42, 44 and 46 are positioned within the pallet 10 by structure which will now be described.

Referring to the base plate 14, it is seen that a plurality of sharp pointed registration pins such as pin 48 are located around the periphery of a relatively large opening 50. The size and shape of the opening 50 is such as to allow the sewing needle 38 to pass therethrough when stitching the various pieces of the workpiece. The registration pins such as 48 are preferably spaced around the periphery of the opening at a spacing between successive pins of seventh-eighths ($\frac{7}{8}$) of an inch. In addition to the spaced registration pins such as 48, the base plate 14 has at least two further sharp pointed pins 52 and 54 that are located away from the periphery of the opening 50. The location of the pins 52 and 54 is such as to allow for the registration of two corners of the bottom piece 40. The base plate 14 also has an edge gauge 56 which conforms to a mid-portion 58 of one edge of the bottom piece 40. This allows the mid-portion 58 of the bottom piece to be aligned with respect to a fixed location on the base plate before engagement with any of the sharp pointed pins. The thus aligned bottom piece is smoothed and slightly stretched so as to allow the two corners of the bottompiece 40 to be registered on pins 52 and 54. Following engagement of the pins 52 and 54, the remainder of the piece 40 is smoothed and stretched over the registration pins located around the opening 50. The intermediate pieces are next temporarily affixed to the bottom piece 40. In this regard the intermediate pieces are preferably backed with adhesive so as to allow for a temporary adherence to a specific location on the bottom piece. Finally, the top piece 46 is aligned with respect to the pattern of registration pins 48 located around the cutout hole 50. The top piece is thereafter fitted down over this pattern of registration pins.

The cover plate 16 is now ready to be rotated downwardly over the thus located pieces on the base plate. The cover plate has a hole 60 of the same size and shape as the hole 50 in the bottom plate. This allows the appropriate portion of the workpiece 12 to be exposed for sewing.

In accordance with the invention, when the cover plate is pivoted downwardly over the base plate, the sharp pointed registration pins 48 will extend through holes such as 62 in the cover plate. In this regard, there is a hole in the cover plate 16 for each and every registration pin extending upwardly from the base plate 14. Each hole must be precisely aligned with a respective registration pin so as to avoid any interference with the cover plate when it closes over the base plate. This requires an accurate hinged connection to the base plate. Referring to the base plate 14, it is to be noted that an alignment block 64 is located between the location holes for the hinges 18 and 20. A notch 66 in the cover plate assures that the cover plate will always be accurately registered with respect to the alignment block. This prevents any lateral looseness of the hinges 18 and 20 from affecting the positioning of the cover plate 16 with respect to the base plate.

Figure 4:
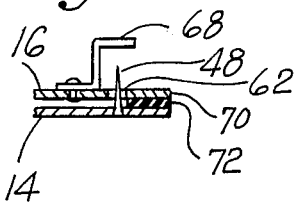
FIG. 4 is a detailed showing of a shield element appearing on the top cover plate of the workpiece holder.

It is to be noted that each hole receiving a registration pin has a shield 68 assoclated therewith. The shield 68 is illustrated in detail in FIG. 4. The shield 68 is seen to comprise a rivoted element that extends upwardlv and thereafter outwardly over the registration pin 48 extending through the hole 62. The sharp point of the registration pin 48 is completely covered by the cantilevered, outwardly extending portion of the shield 68. It is to be furthermore noted that the outwardly extending portion is spaced above the point of the registration pin. This spacing must be sufficient to allow the cover plate 16 to cover over the base plate without a workpiece 12 being present. This spacing requirement must however be balanced against a need to minimize the total elevation of the shield 68 above the surface of the cover plate in order to avoid contact with the sewing needle 38 as the workpiece holder 10 is being positioned by the positioning apparatus either prior to, during, or after sewing. In this regard, the total height of each shield 68 above the cover plate surface is preferably one quarter (0.250) of an inch.

Referring again to FIG. 4, it is seen that a peripheral edge 70 of the opening 60 in the cover plate is illustrated relative to the shield 68 and pin 48. This peripheral edge 70 is only a short distance from the pin 48 as can be appreciated by referring to FIG. 3. It is to be noted that a thickness of rubber 72 is affixed to the underside of the cover plate 16 near the peripheral edge 70. This thickness of rubber extends around the entire periphery of the opening 60. This produces a local clamping pressure immediate to the sewing path of the needle 38.

It is to be appreciated that when the cover plate 10 is closed, the pieces 40, 42, 44 and 46 of FIG. 2 will all be accurately registered and held with respect to each other. The pattern of registration pins maintains the elastic materials in place whereas the precisely associated shields allow the workpiece holder to be easily handled for automated sewing without concern for the sharp nature of the registration pins.

From the foregoing, it is to be understood that a preferred embodiment of a workpiece holder for holding a workpiece during automatic sewing has been disclosed. Various structural aspects of this workpiece holder may be changed without departing from the scope of the invention. For instance, a different workpiece might require a different pattern of registration pins than that disclosed in the preferred embodiment.

What is claimed is:

1. A workpiece holder which is attachable to positioning apparatus associated with the sewing head of an automatic sewing machine whereby the workpiece holder can be automatically positioned with respect to a reciprocating needle in the sewing head so as to allow a workpiece held within the workpiece holder to be sewn said workpiece holder comprising:

a base plate having a plurality of spaced, sharp pointed pins which extend upwardly therefrom so as to define a pattern of spaced, sharp pointed pins that receive an elastic workpiece that is smoothly mounted thereover;

a cover plate, pivotally attached to the base plate, and having a pattern of spaced holes therein which acommodate the spaced, sharp pointed pins when said cover plate is latched with respect to said base plate;

means, on the cover plate, for shielding the sharp points of said sharp pointed pins from inadvertent contact with the operator of the sewing machine who handles the workpiece holder during the normal processing of the workpiece holder; and means on the base plate for attaching said base plate to the positioning apparatus of the automatic sewing machine whereby the workpiece holder can be automatically positioned with respect to the sewing needle of the automatic sewing machine without said shielding means interfering with the sewing needle.

2. The workpiece holder of claim 1 wherein the pivotal attachment of said cover plate with respect to said base plate comprises:

a pair of hinges connecting said cover plate to said base plate; and means located between said pair of hinges, for maintaining a lateral alignment of said cover plate with respect to said base plate as said cover plate is pivoted downwardly over said base plate.

3. The workpiece holder of claim 1 wherein said base plate and said cover plate have respective openings therein which expose that portion of the workpiece that is to be sewn and wherein a substantial portion of said spaced, sharp pointed pins are equally spaced around the periphery of the opening in said base plate and wherein the holes in said cover plate for accommodating these particular sharp pointed pins are also equally spaced around the opening in said cover plate.

4. The workpiece holder of claim 1 wherein each of said spaced, sharp pointed pins extend upwardly through respective holes in said cover plate so as to collectively define a pattern of protruding sharp pin points that protrude above the surface of the cover plate, and wherein said shielding means comprises:

means, associated with each respective hole in said cover plate that accommodates a sharp pointed pin, for shielding the sharp points of said sharp pointed pins from inadvertent contact with an operator of the sewing machine who handles the workpiece holder during the normal processing of the workpiece holder for automatic sewing.

5. The workpiece holder of claim 4 wherein said means for shielding the sharp points comprises:

a plurality of individual shields each of which is associated with a given hole in said cover plate so as to shield the sharp point of the pin protruding through the given hole.

6. The workpiece holder of claim 5 wherein each of said shields comprises:

a shielding piece connected to the top surface of the cover plate, adjacent a hole which accommodates a sharp pointed pin, said shielding piece extending first upwardly and thereafter outwardly in a plane parallel with the cover plate.

7. The workpiece holder of claim 6 wherein the outwardly extending portion of each shielding piece lies in a plane which is at a height above the cover plate that does not interfere with the needle of the automatic sewing machine when being positioned thereunder.

8. A device for holding a plurality of pieces of work that are to be joined and sewn together, said device comprising:

a base plate having a first plurality of sharp pins located around the periphery of an opening which allows a reciprocating sewing needle to pass therethrough so as to sew the pieces together; and a hinged cover plate having a plurality of holes therein which accommodate the sharp pins that extend therethrough when said cover plate is pivoted downwardly over the base plate said cover plate furthermore having individual means for shielding each sharp pin extending through a respective hole.

9. The device of claim 8 further comprising:

a second plurality of pins spaced from said first plurality of pins so as to define a set of pins which register only a first piece of work on the base plate;

10. The device of claim 8 wherein each of said individual shielding means comprises:

a shielding piece connected to the top surface of the cover plate, adjacent a respective hole for receiving a pin, said shielding piece extending first upwardly from the cover plate and thereafter outwardly in a plane parallel with the cover plate.

11. The device of claim 10 wherein the outwardly extending portion of each shielding piece lies in a plane which is at a height above the cover plate that does not interfere with the needle of an automatic sewing machine when the device is being automatically positioned thereunder.

12. The workpiece holder of claim 1 wherein said sharp pointed pins protrude upwardly through the holes in said cover plate so as to collectively define a pattern of protruding sharp points that protrude above the surface of the cover plate and wherein said means for shielding the sharp points of said sharp pointed pins extends only to a height above the surface of the cover plate which does not interfere with the needle of the automatic sewing machine when the workpiece holder is being automatically positioned thereunder by the positioning apparatus.

13. The device of claim 8 wherein said individual means for shielding each sharp pin extending through a respective hole comprises:

means extending above the cover plate and over each sharp pin at a height which does not interfere with the needle of the automatic sewing machine when the device is positioned thereunder.

* * * * *